US006745987B2

(12) United States Patent
Rousselet et al.

(10) Patent No.: US 6,745,987 B2
(45) Date of Patent: Jun. 8, 2004

(54) DEVICE FOR SELECTIVELY IMMOBILIZING A CONTAINER ON A SURFACE, CONTAINER INCLUDING THE DEVICE, AND METHOD FOR MANUFACTURING THE DEVICE

(75) Inventors: Guilhem Rousselet, Paris (FR); Nicolas Albisetti, Clichy (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/956,789

(22) Filed: Sep. 21, 2001

(65) Prior Publication Data

US 2002/0079417 A1 Jun. 27, 2002

(30) Foreign Application Priority Data

Sep. 21, 2000 (FR) ..... 00 12041

(51) Int. Cl.[7] ..... A45D 42/14

(52) U.S. Cl. ..... 248/363; 248/205.5; 248/309.3; 248/346.01; 248/362; 248/683

(58) Field of Search ..... 248/363, 683, 248/205.5, 362, 309.3, 346.01, 311.2, 346.11

(56) References Cited

U.S. PATENT DOCUMENTS

| | | | | | |
|---|---|---|---|---|---|
| 2,210,102 | A | * | 8/1940 | Steudel | 65/15 |
| 2,684,172 | A | * | 7/1954 | Ruppert | 220/15 |
| 2,871,615 | A | | 2/1959 | Borah | |
| 2,908,473 | A | * | 8/1959 | Snyder | 248/359 |
| 2,963,256 | A | * | 12/1960 | Borah | 248/346 |
| 2,968,888 | A | * | 1/1961 | Borah | 45/28 |
| 3,288,420 | A | * | 11/1966 | Maruoka | 248/359 |
| 4,756,497 | A | * | 7/1988 | Lan | 248/205.9 |
| 4,760,987 | A | * | 8/1988 | Lan | 248/346.11 |
| 4,833,823 | A | * | 5/1989 | Edwards, III | 47/39 |
| D305,374 | S | * | 1/1990 | Sahm | D34/38 |
| 4,955,493 | A | | 9/1990 | Touzani | |
| 5,180,132 | A | * | 1/1993 | Pearson | 248/362 |
| 5,209,013 | A | * | 5/1993 | Sellers | 47/71 |
| 5,524,783 | A | * | 6/1996 | Popoff | 245/386 |
| 5,951,291 | A | * | 9/1999 | Albert | 433/215 |
| 5,961,086 | A | * | 10/1999 | Moore et al. | 248/314 |
| 6,123,220 | A | * | 9/2000 | Williams | 220/737 |
| 6,302,302 | B1 | * | 10/2001 | Albisetti | 222/153.1 |
| 6,305,656 | B1 | * | 10/2001 | Wemyss | 248/309.4 |
| 6,318,600 | B1 | * | 11/2001 | Winnett et al. | 222/173 |

FOREIGN PATENT DOCUMENTS

DE 31 44 061 5/1983

OTHER PUBLICATIONS

Pub US2002/0010278 Jan. 2002 Garcia–Franco, p. 1.*
Pub US2001/0049001 Dec. 2002 Mueller, p. 9.*
Pub US2001/0003625 Jul. 2001 Apgar, p. 3.*
Patent Publication US2002/0134903, Lin, Coffee Mug REmovable Docking Station, Sep. 2002.*
Patent Publication US2002/0121583, Jones, Pedstal Support for an Elevated Paver Deck Aseembly, Sep. 2002.*

* cited by examiner

*Primary Examiner*—Leslie A. Braun
*Assistant Examiner*—Amy J. Sterling
(74) *Attorney, Agent, or Firm*—Finnegan, Henderson, Farabow, Garrett & Dunner, LLP

(57) ABSTRACT

A device for selectively immobilizing a container, such as a container containing a cosmetic product, on a surface may include a sleeve having a free edge defining an opening for mounting the device on the container. One end of the device remote from the free edge may form a perforated bottom, a peripheral edge of which may form a lip configured to be pressed in sealed manner onto the surface. In collaboration with a portion of the container, the device may form a suction cavity to thereby selectively immobilize the container on the surface. The perforated bottom may optionally define at least one opening, where the at least one opening may extend away from the geometric center of the bottom.

68 Claims, 5 Drawing Sheets

DEVICE FOR SELECTIVELY IMMOBILIZING A CONTAINER ON A SURFACE, CONTAINER INCLUDING THE DEVICE, AND METHOD FOR MANUFACTURING THE DEVICE

The present invention relates to a device for selectively immobilizing a container on a surface, a container including the device for selectively immobilizing the container, and a method for manufacturing the device for selectively immobilizing a container. The container may be an aerosol container, a pump-action container, a bottle, or a tube-type container, for holding a product, such as a cosmetic product, for example a make-up product or beauty care product. Cosmetic products may include, but are not limited to, hair products such as lacquers, styling mousses, gels, and shampoos. The invention also relates to a device that may capable of reducing the risk of such containers being overturned when the containers are placed in an upright position on a surface, such as a flat support.

Many cosmetic products may be packaged in containers, the dimensions of which are such that they are overturned relatively easily when placed on a work surface. Such containers may often have a generally cylindrical shape and a relatively tall height in comparison to their cross-section. The ease with which such containers may be overturned may be an important issue, particularly in the environment of hairdressing salons, where a many such containers may be used. In hairdressing salons, the electric cords of hair driers may drape across work surfaces on which containers may be placed. The movement of these electric cords often results in the containers being overturned. Aside from the unpleasant noise caused by such occurrences, the risk of damage to the containers, for example, to the dispensing systems of such containers, may be considerable.

An example of a conventional device can be found in U.S. Pat. No. 2,908,473, which discloses a bottle, for example, a nail varnish bottle, the bottom of which is equipped with a device in the form of an annular element, a peripheral lip of which may be capable of forming a suction-cup.

When produced by injection molding, such a device requires that the injection point be situated at the periphery of the device, in a position that may be appreciably offset from the geometric center of the device forming the suction-cup. As a consequence of this off-center injection point, there may be a weld line that results in an area of weakness. This problem may be more critical when the material from which the device is formed is a flexible material, and when the device is intended to operate under constant mechanical stress, for example, when placed in an elastic gripping function.

One possible solution to the abovementioned situation may be found by producing a device in the form of a cylindrical skirt, a first end of which may be open and a second end of which is spaced from the first end. The second end may be provided with a closed bottom. However, this configuration may present a problem during manufacturing when the device is released from the mold due to a suction-cup effect with the mold insert, rendering separation from the mold difficult.

Another example of a conventional device can be found in DE 31 44 061 A1, which describes a container having a configuration of a tube for use in containing a product. A cap of the tube may be configured to form a suction-cup. Such a configuration may require immobilizing the container in an inverted position. However, inverting the container may be undesirable for many products. Furthermore, this device suffers from a similar problem to that which was previously mentioned in connection with U.S. Pat. No. 2,908,473, namely, difficulty removing the device from the mold.

Other examples of conventional devices are found in U.S. Pat. No. 4,955,493, and U.S. Pat. No. 4,756,497, which disclose immobilizing devices that may include a suction-cup effect. These devices are formed from at least two parts mounted on one another. Such devices may be expensive to produce. Further, such devices may also be relatively difficult to position on the containers for which they were intended.

Yet another example of a conventional device is found in U.S. Pat. No. 2,968,888, which describes a support for objects such as soaps or beverages. The device includes one part intended to hold the object and another part for forming a suction-cup. The suction-cup is formed entirely as part of the support. Thus, the support may act as a suction-cup regardless of the presence of the object intended to be held. As a result, problems may arise with handling the support, for example, on manufacturing lines, or industrial packaging lines. These problems may include unintended occurrences of the suction-cup adhering to surfaces encountered during manufacturing and packaging. Furthermore, problems may also be encountered as the device is released from the mold. For example, since the suction-cup has an uninterrupted surface, it may have a tendency to adhere the surface of the mold as previously described.

Hence, one optional aspect of the invention is to produce a device for selectively immobilizing a container on a surface that either completely or partly addresses the disadvantages of the devices in the documents cited above.

Another optional aspect of the invention is to produce a device that can be manufactured by injection molding and that is able to withstand mechanical stresses associated with mounting and retaining the device on a container for which the device is intended.

Yet another optional aspect of the invention is to provide a device that significantly improves the stability of a container without requiring modification of the container.

A further optional aspect of the invention is to provide a device that is simple and economical to produce.

Another optional aspect of the invention is to provide a container having improved stability when equipped with a device according to the invention.

Other optional aspects still will become apparent from the following detailed description.

For the purposes of this disclosure, the term "suction cavity" refers to a volume having a relatively reduced pressure with respect to pressure surrounding the volume. This relatively reduced pressure may be achieved through the act of depressing and releasing an at least partially elastic member onto a surface such that a volume defined at least in part by the elastic member and the surface is initially reduced, forcing air from the volume. Once the volume is reduced, a slight expansion of the reduced volume occurs as the elastic member partially returns to a configuration present prior to the act of depressing. As a result of the depressing and expanding, the suction cavity may provide an immobilizing phenomenon with respect to the elastic member and a container attached thereto. For example, the structure defining the suction cavity could be generally in the form of what is sometimes referred to as a suction-cup.

According to a first aspect of the invention, a device for selectively immobilizing a container on a surface is provided. The device may optionally include a mounting element configured to engage the container, and a bottom. The bottom may include a central portion, a peripheral edge forming a lip, and at least one opening extending away from the central portion. The bottom may be configured such that at least the container and the bottom cooperate to form a suction cavity for selectively immobilizing the container on the surface.

According to a second optional aspect of the invention, a device for selectively immobilizing a container on a surface is provided which may optionally include a mounting element configured to engage the container, and a bottom. The bottom may include a central portion, a peripheral edge forming a lip, a groove configured to engage the container, and at least one opening. The bottom may be configured such that at least the container and the bottom cooperate to form a suction cavity for selectively immobilizing the container on the surface.

Yet another optional aspect of the invention includes a device for selectively immobilizing a container on a surface. The device may include a mounting element configured to engage the container, and a bottom. The bottom may include a central portion at least partially located at a geometric center of the bottom, a peripheral edge forming a lip, and at least one opening defined at least partially by the central portion and the peripheral edge of the bottom. The bottom may be configured such that at least the container and the bottom cooperate to form a suction cavity for selectively immobilizing the container on the surface.

According to another optional aspect of the invention, a device for selectively immobilizing a container on a surface is provided. The device may include a mounting element configured to engage the container, and a bottom including a central portion, a peripheral edge forming a lip, a groove configured to engage the container, and a plurality of openings intermediate the central portion and the peripheral edge of the bottom with the openings being separated by at least one radially extending tab. The bottom is optionally configured such that at least the container and the bottom cooperate to form a suction cavity for selectively immobilizing the container on the surface.

An additional optional aspect of the invention may include a device wherein the mounting element includes a sleeve defining a free edge for receiving the container, with the free edge being spaced from the bottom.

Yet another additional aspect of the invention includes a device wherein the sleeve is configured to elastically deform, thereby gripping the container.

An additional aspect of the invention includes a device wherein said at least one opening comprises at least two openings.

Another optional aspect of the invention includes a device, wherein said at least one opening comprises three openings, the three openings being separated by three radially extending tabs spaced about 120 degrees with respect to one another.

Optionally, in another aspect of the invention, said at least one opening may include four openings, with the four openings being separated by four radially extending tabs spaced about 90 degrees with respect to one another.

In another optional aspect of the invention, the device may be formed at least partially from an elastomeric material having a hardness ranging from about 20 Shore A to about 40 Shore D and an elasticity ranging from about 0.5 MPa to about 5 MPa.

According to another optional aspect of the invention, the elastomeric material may have a hardness ranging from about 40 Shore A to about 75 Shore A and an elasticity ranging from about 0.8 MPa to about 2 MPa.

In yet another optional aspect of the invention, the device may be at least partially formed from a blend at least partially comprising metallocene catalysis polyethylene.

According to another optional aspect of the invention, the device may include a blend comprising from about 5% to about 30% of metallocene catalysis polyethylene.

In an additional aspect of the invention, the blend may optionally comprise from about 10% to about 20% of metallocene catalysis polyethylene.

According to yet another optional aspect of the invention, the device may include a blend further comprising at least one material chosen from EPDM (ethylene-propylene-diene copolymer), EPDM blended with a polypropylene, and EPDM blended with SBS (styrene-butadiene-styrene block copolymer).

In yet another optional aspect of the invention, the device may include a blend further comprising at least one material chosen from SEBS (styrene/ethylene-n-butylene block copolymer), SEBS blended with a polypropylene, SEBS blended with PEBA (polyether-block-amide), SEBS blended with COPE (a polyethylene terephthalate elastomer), and SEBS blended with TPU (thermoplastic polyurethane).

As an example of another optional aspect of the invention, the device may be formed as a single-piece, injection-molded product.

In another optional aspect of the invention, the device may include a lip that is configured to be pressed in a sealed manner onto the surface so as to form a suction cavity along with the container.

In yet another optional aspect of the invention, the device may be configured such that at least a portion of the central portion is located at the geometric center of the bottom.

In an additional optional aspect of the invention, a combination of a container and a device for selectively immobilizing the container on a surface is provided. The combination may include a container comprising a body having a terminal end defining a bottom, and a device according to any optional aspects of the invention mounted on the terminal end of the container body.

In an additional optional aspect of the invention, the body may define a diameter and the lip may be configured to define a diameter at least as large as the diameter of the body when the lip is engaged with the surface.

According to another optional aspect of the invention, a combination may be provided in which a profile of the bottom of the device substantially corresponds to a profile of the bottom of the container body.

In another optional aspect of the invention, a combination may be provided in which the bottom of the container may define a concave profile and the bottom of the device may define a convex profile.

According to another optional aspect of the invention, the body may comprise a reservoir, the reservoir being closed by the bottom of the container.

In another optional aspect of the invention, the container may comprise one of a tube, a bottle, a pump-action container, and an aerosol container.

In an additional optional aspect of the invention, a cosmetic product may be contained in the container.

In another optional aspect of the invention, the device and at least a portion of the container body may form a suction cavity.

According to another optional aspect of the invention, a method of manufacturing the device according to any optional aspects of the invention is provided. The method may include providing a mold having a cavity configured for forming the device, and injecting a material into the mold at an injection area corresponding to the central portion of the bottom of the device.

According to another optional aspect of the invention, the device may further include a groove wherein the groove is U-shaped.

In yet another optional aspect of the invention, the openings may include four openings, wherein adjacent pairs of openings are separated by one of four tabs spaced 90 degrees with respect to one another.

By virtue of at least one opening passing through the bottom of the device, the device may be easily released from a mold during manufacturing. As a result of the openings in the bottom of the device, the device according to an exemplary embodiment only forms a suction cavity when mounted on a container. Furthermore, in an exemplary arrangement where a centrally located area of the bottom of the device is free of openings, the material forming the device can be injected via the geometric center of the device, thereby enabling the material, when injected into a mold, to spread out uniformly and simultaneously around the injection point. Through this manner of manufacture, it may be possible to form the device without precipitating the formation of a weld line that might split when the device is placed under mechanical stress.

Furthermore, mounting the device on a container for which it is intended may be both simple and effective. Mounting the device may require no special tools. The device may be mounted reversibly on the container, making it possible for the same device to be used successively on numerous containers.

The various parameters of the device, for example, dimensions of the device and the material used for forming the device, may be chosen on the basis of the dimensions of the container to which the device is to be equipped, on the basis of the surface finish of the exterior walls of the device, and on the basis of the required firmness with which the container is to be held on the support. Other factors too may be taken into consideration when determining these production parameters.

In an exemplary embodiment, by incorporating part of the container to define part of the volume of the suction cavity, as opposed to the suction cavity being defined entirely by the device itself, the amount of material required for producing the device may be appreciably reduced, thereby reducing the cost of producing of the device. Furthermore, such an exemplary embodiment of the device could be configured to be unable to produce a suction cavity without the presence of the container to which it is to be attached. As a result, handling the device may become easier, for example, on industrial production lines. Finally, where the effect of the suction cavity is obtained through the combination of the device and a corresponding portion of the container, any propensity for the container to separate from the device may break the continuity, thereby eliminating the effect of the suction cavity. As a result, the device forming the suction cavity will not easily detach itself from the container.

As an example, the sleeve may be capable by elastic deformation of gripping part of the axial height of the axial height of the container. Optionally, the axial height may be on the order of about a few centimeters. Alternatively, the sleeve could be bonded, snap-fastened, or threadedly engaged with the container.

In one optional aspect of the invention, the bottom of the device may define at least two openings allowing for a symmetry around the geometric center of the bottom of the device. This feature may greatly improve the uniformity of the distribution of the material when the device is produced, for example, by injecting the material into a mold cavity. As a result of the injection point corresponding to the geometric center, the overall mechanical resistance of the device may be greatly improved. Furthermore, the greater the number of tabs or bridges of material, the lower the risks of generating lines of weakness.

Optionally, the device may be constructed, at least in part, from an elastomeric material, the hardness of which may range from about 20 Shore A to about 40 Shore D, for example, from about 40 Shore A to about 75 Shore A, and the elasticity of which may range from about 0.5 MPa to about 5 MPa, for example, from about 0.8 MPa to about 2 MPa (tensile stress at 100% elongation).

Also, the elastomeric material may be a blend formed at least partially of metallocene catalysis polyethylene, for example, a very low density catalysis polyethylene. A blend formed from such a material, in combination with another basic material, examples of which will be given hereinafter, may allow automatic release of the device from a mold during manufacturing. The hardness and the elasticity of the basic material with which the metallocene catalysis polyethylene is blended may not be appreciably affected, which means that the functionality of the device resulting from molding may remain undiminished. Furthermore, resistance to tearing may be improved appreciably over that of the basic material or materials. Finally, the visual properties of the basic material, for example, its transparency or its color, may remain unchanged.

Optionally, the blend may at least partially contain from about 5% to about 30% of the metallocene catalysis polyethylene, for example, from about 10% to about 20%. By way of a specific example, use may be made of a very low density (about 0.902 g/cm$^3$) catalysis polyethylene known by the trade name EXACT™. Since this material may be less expensive than some of the basic materials that will be discussed hereinbelow, the overall cost of the device may be correspondingly reduced.

Optional examples of materials that may be used in combination with the metallocene catalysis polyethylene, are materials based on:

a) EPDM (ethylene-propylene-diene copolymer), possibly blended with a polypropylene (eg: Santoprene™);
b) SBS (styrene-butadiene-styrene block copolymer), or SEBS (styrene/ethylene-n-butylene block copolymer), possibly blended with a polypropylene (eg: Tefabloc™ or Multiflex™);
c) PEBA (polyether-block-amide) or COPE (a polyethylene terephthalate elastomer); and/or
d) TPU (thermoplastic polyurethane).

Such materials, when used alone, may be relatively sticky and therefore, may be very difficult to release automatically from the mold. In addition, once released from the mold they may deform appreciably. Finally, they may offer little resistance when under mechanical stress, and therefore, may be likely to tear. Once blended with the aforementioned metallocene catalysis polyethylene, at least some of these problems may be substantially solved.

The container may comprise a body having one end which terminates in a bottom, and the portion of the container that may be capable, in combination with the device, of forming a suction cavity may include all or part of the bottom of the container.

According to another optional aspect of the invention, the part of the container capable in combination with the immobilizing device of forming a suction cavity, may consist of all or part of a cap of a container including a tube intended to be placed on a support in an inverted position via a surface formed by the cap of the tube.

According to yet another optional aspect of the invention, the bottom of the device may have a profile, for example a convex profile, capable of following the profile of the bottom of the container. In practice, a bottom having a convex profile may correspond to commonly configured aerosol containers. Often, aerosol containers are configured with concave bottoms in order to withstand the pressure within the container.

According to another optional aspect of the invention, a container, such as a container containing a cosmetic product, is equipped with a device having a suction cavity effect. Optionally, the container may include a body forming a reservoir for the product, the body being closed at one end by a bottom which, in collaboration with the device, is capable of forming a suction cavity in combination with a support.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic exploded view showing an exemplary embodiment of a container and a device for selectively immobilizing the container according to an optional aspect of the invention;

Figure 1:
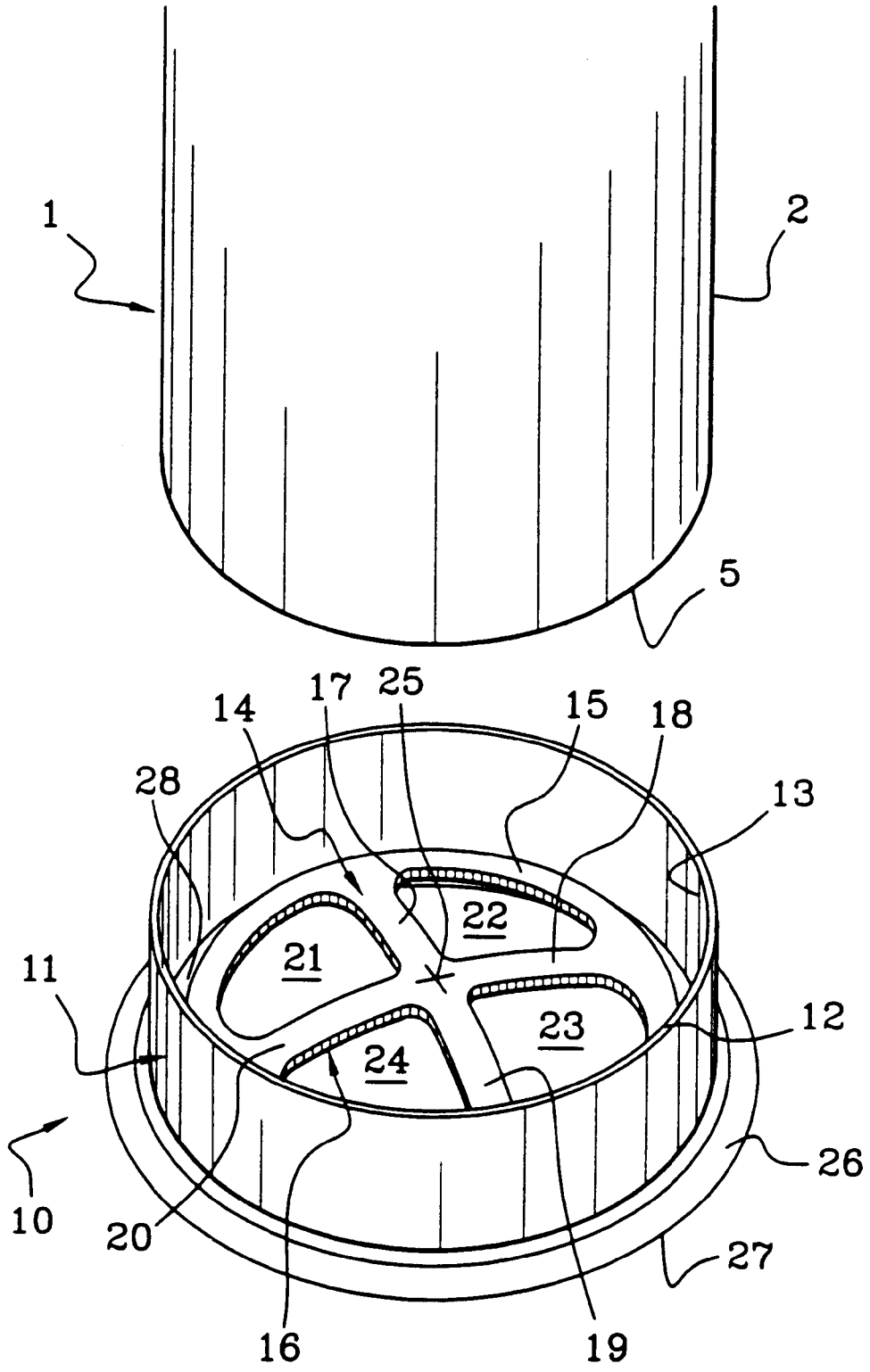
Figure 2:
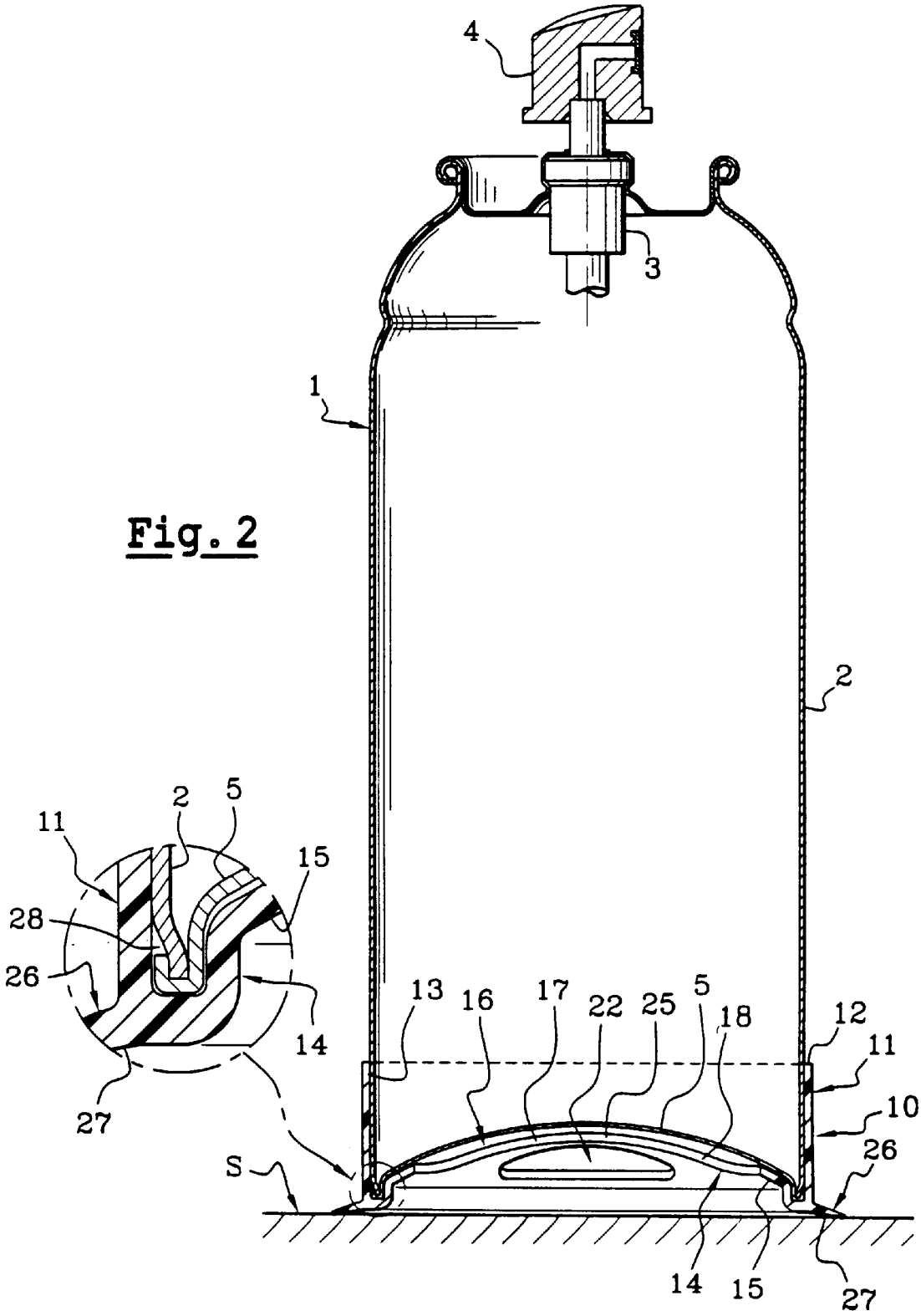
FIG. 2 is a schematic elevation view combined with a partial section-view of an optional embodiment of the device and container according to an optional aspect of the invention.

FIG. 2 schematically illustrates a container 1, for example, an aerosol container, resting on a surface S, such as a work surface in a hairdressing salon. The container 1 may comprise a cylindrical body 2 surmounted by a dispenser means 3, which may alternatively be a valve for an aerosol container, or a pump element for dispensing a liquid, for example. The dispenser means 3 may be equipped with a push-button 4 capable of actuating the dispenser means 3 and propelling the product through an outlet nozzle in a manner such as spraying or diffusing. The product may be, for example, a hairstyling lacquer or a spray. The end of the container 1 remote from the dispenser means 3 may be closed by an attached bottom 5 which, for reasons of withstanding the possible pressure inside the container 1, may be provided with a concave shape. Alternatively, as shown in FIG. 1, the container 1 may be a tube having a cap comprising a body 2, for example. The container 1 may be made of thermoplastic material such as, but not limited to, PET, or of metal such as aluminum or tin plate. Mounted on the bottom or cap of the container 1, is a device 10 according to an optional embodiment of the invention whose function may be for preventing the container 1 from being overturned onto surface S.

Figure 3:
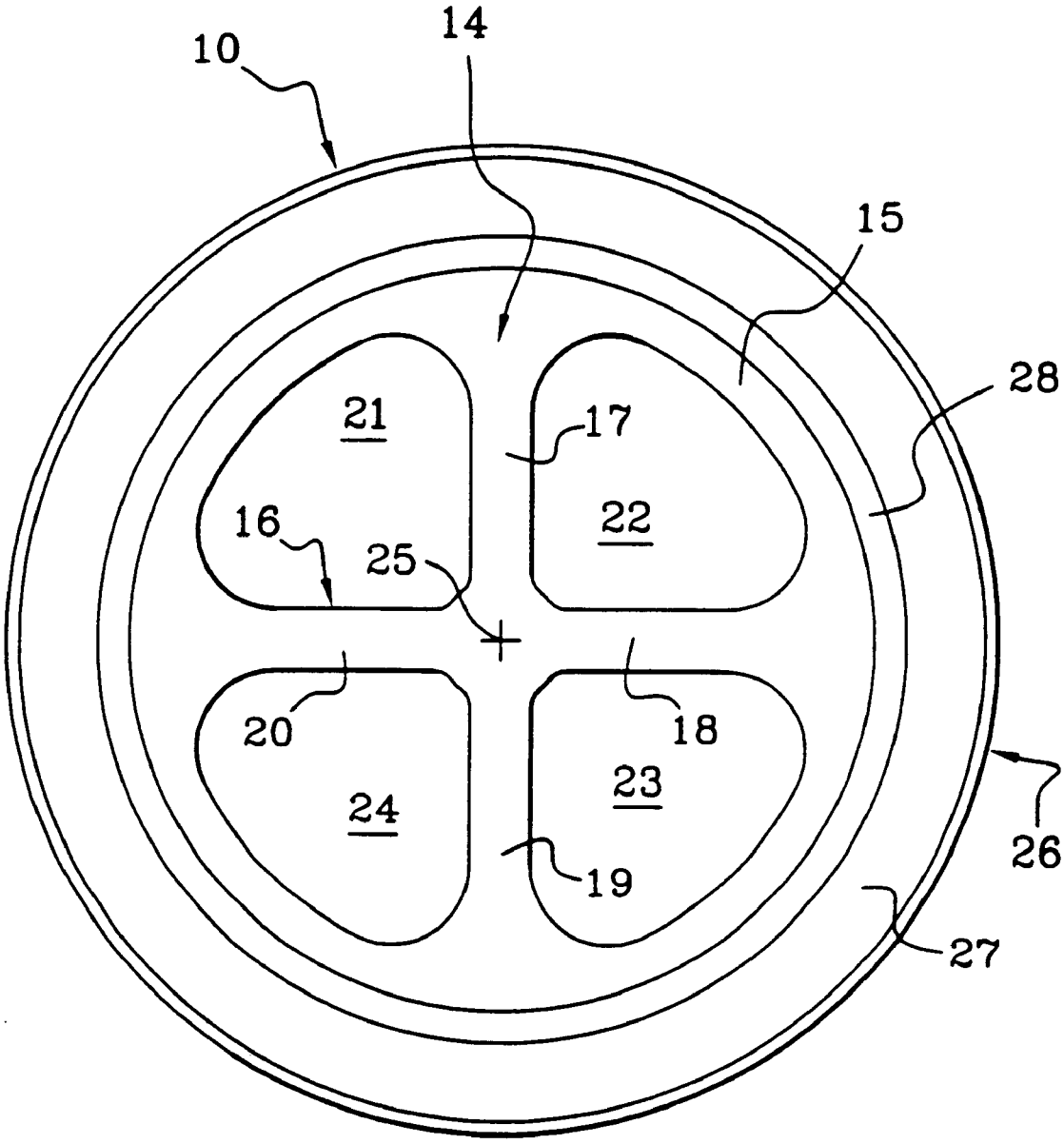
FIG. 3 is a plan view of the device of FIG. 1.

The device 10 will now be described in detail with reference to FIG. 1, which shows the assembly of FIG. 2 in an exploded view, and with reference to FIG. 3. The device 10 may formed by injection-molding a material containing from about 20% of EXACT™ and from about 80% of Santoprene™. The device 10 may be opaque, transparent, translucent, and/or any color, such as white, or any combination thereof.

According to this optional embodiment, the device 10 is in the form of an axisymmetric cylindrical sleeve 11, one end of which has a free edge 12 delimiting an opening 13 allowing the device 10 to be mounted in the manner illustrated in FIG. 2. The inside diameter of the sleeve 11 may be slightly smaller, for example from about 1 millimeter to about a few millimeters smaller, depending on the elasticity of the material, than the outside diameter of the container 1 such that the sleeve 11 may be mounted so that the sleeve 11 grips relatively tightly on the body 2 of the container 1. The wall thickness of the device 10 may be about 1 millimeter, although other thicknesses may be contemplated.

An end of the sleeve 11 remote from an end adjacent the opening 13 may be provided with a bottom 14 of circular cross-section. It is further contemplated that numerous cross-sections having alternative shapes could be provided, such as, but not limited to, elliptical, oblong, triangular, square, and polygonal. The bottom 14 may have an annular portion 15 of convex profile similar to the concave profile of the bottom 5 of the container 1. The bottom 14 may be configured to hug the profile of a corresponding annular part of the bottom 5 with which the bottom 14 engages when mounted on the container 1. Inside the annular portion 15, a cross-shaped part 16 may be formed including portions forming four tabs 17,18, 19, and 20, arranged 90° apart, for example, which define four openings 21, 22, 23, and 24. The junction 25 of the four tabs 17,18,19, and 20, may be provided at the geometric center of the bottom 14, resulting in space between the geometric center and the openings 21, 22, 23, and 24.

Figure 4:
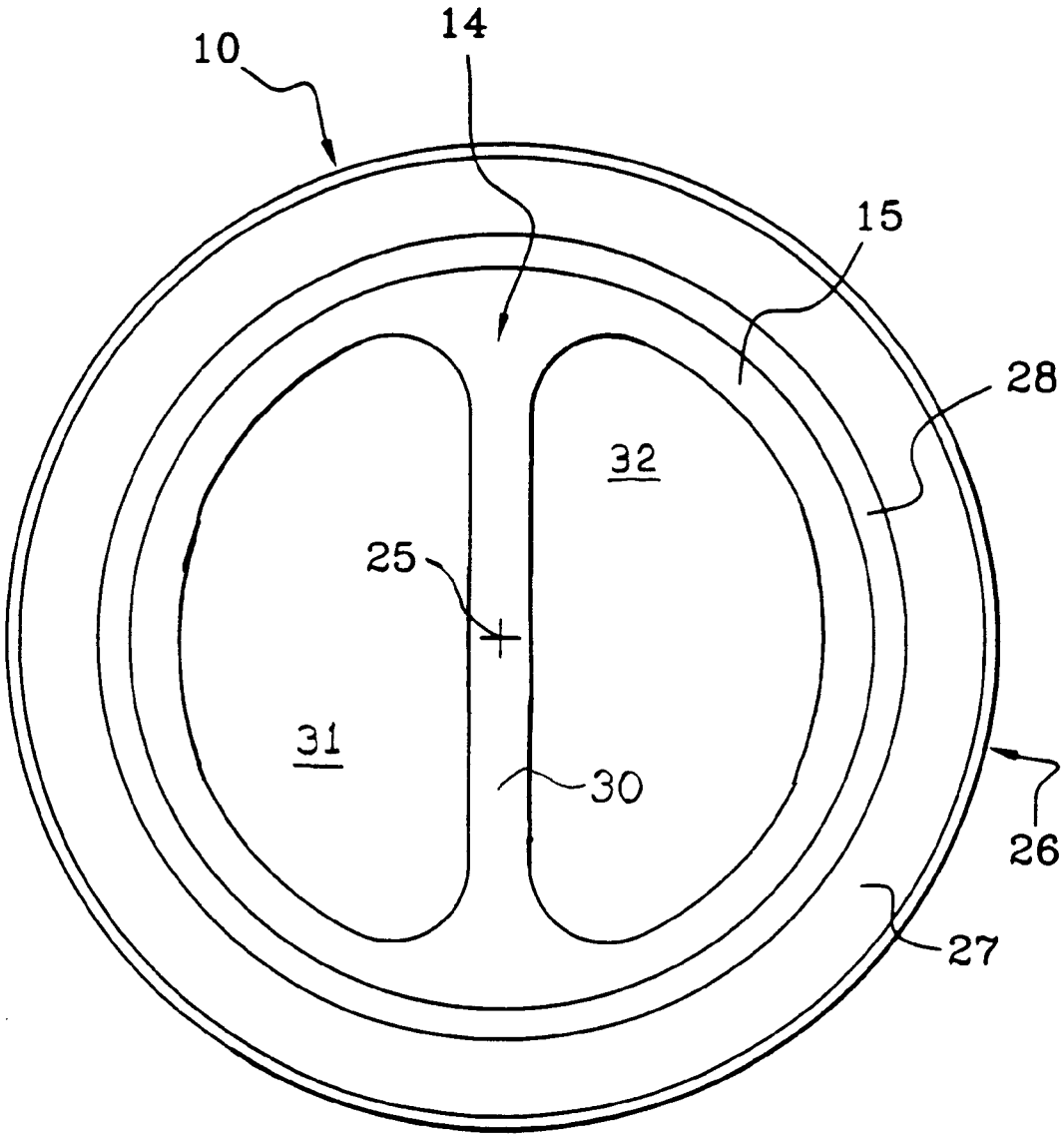
FIG. 4 is a plan view of an alternative embodiment of the device.
Figure 5:
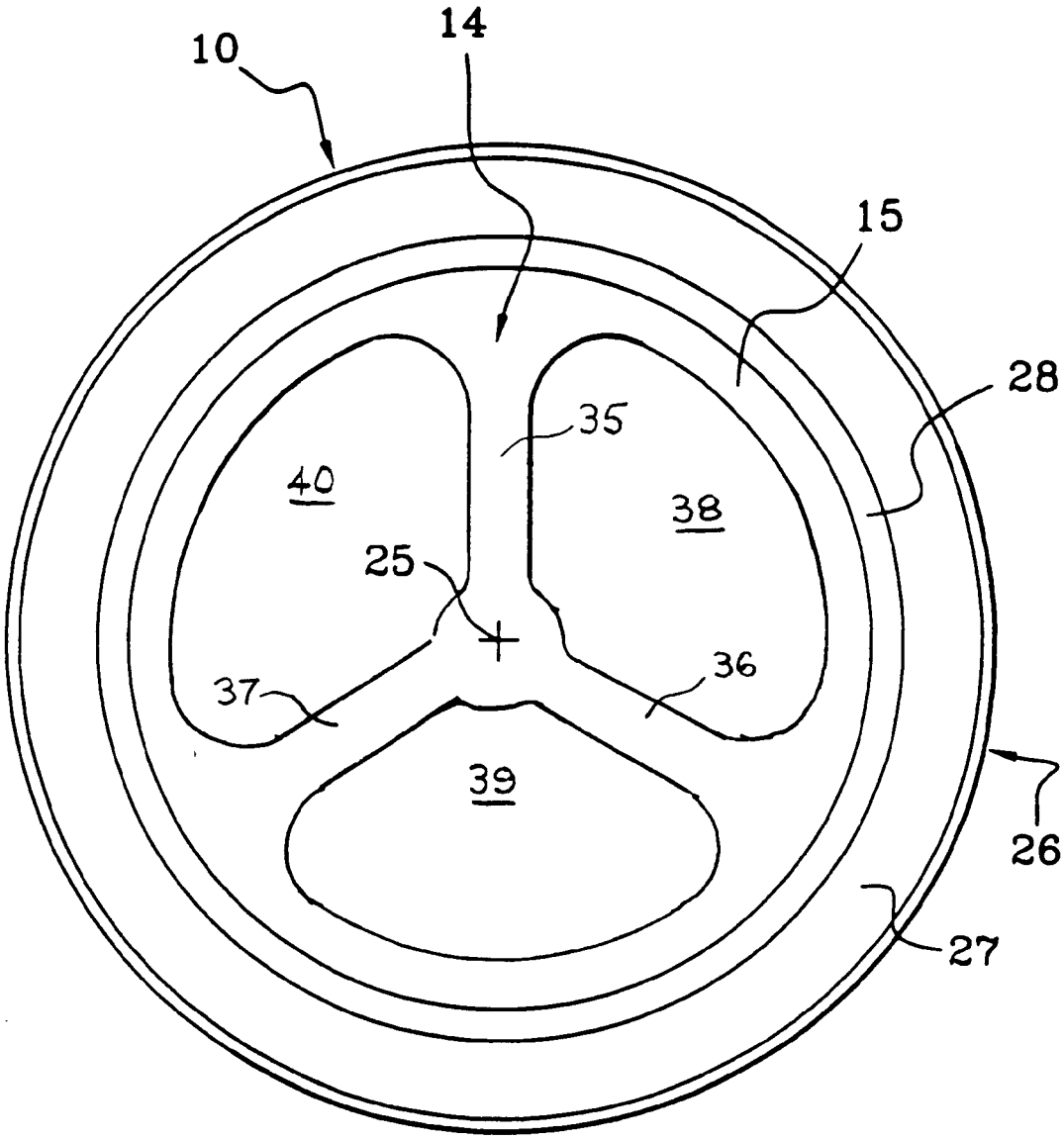
FIG. 5 is a plan view of yet another alternative embodiment.

Alternatively, as shown in FIGS. 4 and 5, for example, the bottom 14 may include any number of openings other than four. For example, as shown in FIG. 4, inside the annular portion 15 of the bottom 14, may include a portion forming a tab 30, defining two openings 31 and 32. Alternatively, as shown in FIG. 5, the bottom 14 may include portions forming tabs 35, 36, and 37, which may be arranged 120° apart, defining three openings 38, 39 and 40. The junction 25 of the portions 35, 36, and 37, may be provided at the geometric center of the bottom 14, resulting in space between the geometric center and the openings 38, 39 and 40.

The annular element 15 may be provided with a periphery that forms an annular sealing lip 26 of a diameter greater, for example by about 5 millimeters, than the outside diameter of the sleeve 11. A surface 27 of the sealing lip 26 may be applied in a sealed fashion against the surface S. The surface 27 of the lip 26 may form a curvature in the same orientation as the curvature formed by the annular portion 15 of the bottom 14. The sealing lip 27 may be separated from the internal annular wall 15 by an intermediate annular portion 28 forming a U-shaped groove for accommodating the peripheral edge of the container 1.

The device 10 forming a suction cavity is also shown in FIGS. 1, 3, 4 and 5. In these figures, the device 10 is not shown mounted on a container.

The device 10 may be mounted on the container 1 by inserting the bottom of the container 1 through the opening 13 of the sleeve 11 until the peripheral edge of the container 1 engages in the bottom of the U-shaped groove 28 of the device 10. A tongue, not shown, may extend the free edge 12 of the sleeve 11 so as to form a region to be grasped for rendering the device 10 easier to mount on the container 1. In this position, the sleeve 11 may grip the body 2 of the container 1. The act of the sleeve 11 gripping the body 2 of the container 1 may further ensure that the device 10 is held firmly on the container 1.

Having mounted the device 10 on the container 1, the surface 27 may be placed on the surface S, causing the sealing lip 26 to deform and expel a corresponding volume of air. Under the effect of an elastic return force generated by the elasticity of the material of which the device 10 may be formed, the deformed portion of the lip 26 tends to revert to its initial shape in spite of the seal inside the volume being defined by the support S, the bottom 14 of the device 10, and a central part of the bottom 5 of the container 1. A depression is created inside the volume generating the suction cavity effect capable of selectively of immobilizing the container 1 on the surface S.

In order to use the container 1, the operator may grasp the container 1 by the body 2, and pivot the container 1 towards the surface S. Since the force of the grip between the device 10 and the surface S may not be as strong as the force with which the container is gripped by the device 10, the wall 27 of the sealing lip 26 of the device 10 may detach from the surface S while the device 10 remains attached to the container 1, and the container 1 may thereafter be used in the conventional way.

The containers according to the optional aspects of the invention contain any make-up or care products, such as cosmetic, dermatological, or pharmaceutical compositions used for treating hair, skin lips, nails. However, in its broadest aspects, the present invention could be used with many other products and substances.

Furthermore, sizes of various structural parts and materials used to make the above-mentioned devices and containers are illustrative and exemplary only and one of ordinary skill in the art would recognize that these sizes and materials can be changed as necessary to produce different effects or desired characteristics of the devices and/or containers.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A combination of a container and a device for selectively immobilizing the container on a surface, the combination comprising:

a container comprising a body having a terminal end defining a bottom;

a cosmetic product contained in the container; and a device mounted on the terminal end of the container body, the device comprising a mounting element engaging the container, and a bottom comprising a central portion comprising material, a peripheral edge forming a lip, and at least one opening extending away from the central portion, wherein the bottom is configured such that at least the container and the bottom cooperate to form a suction cavity for selectively immobilizing the container on the surface.

2. The combination of claim 1, wherein the mounting element comprises a sleeve defining a free edge for receiving the container, the free edge being spaced from the bottom.

3. The combination of claim 2, wherein the sleeve is configured to elastically deform, thereby gripping the container.

4. The combination of claim 1, wherein said at least one opening comprises at least two openings.

5. The combination of claim 1, wherein said at least one opening comprises three openings, the three openings being separated by three radially extending tabs spaced about 120 degrees with respect to one another.

6. The combination of claim 1, wherein said at least one opening comprises four openings, the four openings being separated by four radially extending tabs spaced about 90 degrees with respect to one another.

7. The combination of claim 1, wherein the device is formed at least partially from an elastomeric material having a hardness ranging from about 20 Shore A to about 40 Shore D and an elasticity ranging from about 0.5 MPa to about 5 MPa.

8. The combination of claim 7, wherein the elastomeric material has a hardness ranging from about 40 Shore A to about 75 Shore A and an elasticity ranging from about 0.8 MPa to about 2 MPa.

9. The combination of claim 1, wherein the device is at least partially formed from a blend at least partially comprising metallocene catalysis polyethylene.

10. The combination of claim 9, wherein the blend comprises from about 5% to about 30% of metallocene catalysis polyethylene.

11. The combination of claim 10, wherein the blend comprises from about 10% to about 20% of metallocene catalysis polyethylene.

12. The combination of claim 9, wherein the blend further comprises at least one material chosen from EPDM, EPDM blended with a polypropylene, and EPDM blended with SBS.

13. The combination of claim 9, wherein the blend further comprises at least one material chosen from SEBS, SEBS blended with a polypropylene, SEBS blended with PEBA, SEBS blended with COPE, and SEBS blended with TPU.

14. The combination of claim 1, wherein the device is formed as a single-piece, injection-molded product.

15. The combination of claim 1, wherein the lip is configured to be pressed in a sealed manner onto the surface so as to form a suction cavity along with the container.

16. The combination of claim 1, wherein at least a portion of the central portion is located at the geometric center of the bottom.

17. The combination of claim 1, wherein the body defines a diameter and the lip is configured to define a diameter at least as large as the diameter of the body when the lip is engaged with the surface.

18. The combination of claim 1, wherein a profile of the bottom of the device substantially corresponds to a profile of the bottom of the container body.

19. The combination of claim 1, wherein the bottom of the container defines a concave profile and the bottom of the device defines a convex profile.

20. The combination of claim 1, wherein the body comprises a reservoir, the reservoir being closed by the bottom of the container.

21. The combination of claim 1, wherein the container comprises one of a tube, a bottle, a pump-action container, and an aerosol container.

22. The combination of claim 1, wherein the device and at least a portion of the container body form a suction cavity.

23. A method of manufacturing the combination of claim 1, the method comprising:

providing a mold having a cavity configured for forming the device; and injecting a material into the mold at an injection area corresponding to the central portion of the bottom of the device.

24. A device for selectively immobilizing a container on a surface, the device comprising:

a mounting element configured to engage the container; and a bottom comprising a central portion, a peripheral edge forming a lip, a groove configured to engage the container, and at least one opening, wherein the bottom is configured such that at least the container and the bottom cooperate to form a suction cavity for selectively immobilizing the container on the surface, and wherein the device is formed as a single-piece molded product.

25. The device of claim 24, wherein the groove is U-shaped.

26. The device of claim 24, wherein the mounting element comprises a sleeve defining a free edge for receiving the container, the free edge being spaced from the bottom.

27. The device of claim 26, wherein the sleeve is configured to elastically deform, thereby gripping the container.

28. The device of claim 24, wherein said at least one opening extends away from the central portion.

29. The device of claim 24, wherein said at least one opening comprises two openings.

30. The device of claim 24, wherein said at least one opening comprises three openings, the three openings being separated by three radially extending tabs spaced about 120 degrees with respect to one another.

31. The device of claim 24, wherein said at least one opening comprises four openings, the four openings being separated by four radially extending tabs spaced about 90 degrees with respect to one another.

32. The device of claim 24, wherein the device is formed at least partially from an elastomeric material having a hardness ranging from about 20 Shore A to about 40 Shore D and an elasticity ranging from about 0.5 MPa to about 5 MPa.

33. The device of claim 24, wherein the device is formed as a single-piece, injection-molded product.

34. The device of claim 24, wherein the lip is configured to be pressed in a sealed manner onto the surface so as to form a suction cavity along with the container.

35. The device of claim 24, wherein at least a portion of the central portion is located at the geometric center of the bottom.

36. A combination of a container and a device for selectively immobilizing the container on a surface, the combination comprising:

a container comprising a body having a terminal end defining a bottom; and a device mounted on the terminal end of the container body, the device comprising a mounting element configured to engage the container, and a bottom comprising a central portion, a peripheral edge forming a lip, a groove configured to engage the container, and at least one opening, wherein the bottom is configured such that at least the container and the bottom form a suction cavity for selectively immobilizing the container on the surface.

37. The combination of claim 36, wherein the body defines a diameter and the lip is configured to define a diameter at least as large as the diameter of the body when the lip is engaged with the surface.

38. The combination of claim 36, wherein a profile of the bottom of the device substantially corresponds to a profile of the bottom of the container body.

39. The combination of claim 36, wherein the bottom of the container defines a concave profile and the bottom of the device defines a convex profile.

40. The combination of claim 36, wherein the body comprises a reservoir, the reservoir being closed by the bottom of the container.

41. The combination of claim 36, wherein the container comprises one of a tube, a bottle, a pump-action container, and an aerosol container.

42. The combination of claim 36, further comprising a cosmetic product contained in the container.

43. A method of manufacturing the device of claim 24, the method comprising:

providing a mold having a cavity configured for forming the device; and injecting a material into the mold at an injection area corresponding to the central portion of the bottom of the device.

44. A device for selectively immobilizing a container on a surface, the device comprising:

a mounting element configured to engage the container; and a bottom comprising a central portion at least partially located at a geometric center of the bottom, a peripheral edge forming a lip, and at least one opening having a perimeter defined at least partially by the central portion and the peripheral edge of the bottom, wherein the bottom is configured such that at least the container and the bottom cooperate to form a suction cavity for selectively immobilizing the container on the surface, and wherein the device is formed as a single-piece molded product.

45. The device of claim 44, wherein the mounting element comprises a sleeve defining a free edge for receiving the container, the free edge being spaced from the bottom.

46. The device of claim 45, wherein the sleeve is configured to elastically deform, thereby gripping the container.

47. The device of claim 44, wherein said at least one opening extends away from the central portion.

48. The device of claim 44, wherein said at least one opening comprises two openings.

49. The device of claim 44, wherein said at least one opening comprises three openings, the three openings being separated by three radially extending tabs spaced about 120 degrees with respect to one another.

50. The device of claim 44, wherein said at least one opening comprises four openings, the four openings being separated by four radially extending tabs spaced about 90 degrees with respect to one another.

51. The device of claim 44, wherein the device is formed at least partially from an elastomeric material having a hardness ranging from about 20 Shore A to about 40 Shore D and an elasticity ranging from about 0.5 MPa to about 5 MPa.

52. The device of claim 44, wherein the device is formed as a single-piece, injection-molded product.

53. The device of claim 44, wherein the lip is configured to be pressed in a sealed manner onto the surface so as to form a suction cavity along with the container.

54. The device of claim 44, wherein at least a portion of the central portion is located at the geometric center of the bottom.

55. A combination of a container and a device for selectively immobilizing the container on a surface, the combination comprising:

a container comprising a body having a terminal end defining a bottom; and the device of claim 44 mounted on the terminal end of the container body.

56. The combination of claim 55, wherein the body defines a diameter and the lip is configured to define a diameter at least as large as the diameter of the body when the lip is engaged with the surface.

57. The combination of claim 55, wherein a profile of the bottom of the device substantially corresponds to a profile of the bottom of the container body.

58. The combination of claim 55, wherein the bottom of the container defines a concave profile and the bottom of the device defines a convex profile.

59. The combination of claim 55, wherein the body comprises a reservoir, the reservoir being closed by the bottom of the container.

60. The combination of claim 55, wherein the container comprises one of a tube, a bottle, a pump-action container, and an aerosol container.

61. The combination of claim 55, further comprising a cosmetic product contained in the container.

62. The combination of claim 55, wherein the device and at least a portion of the container body form a suction cavity.

63. A method of manufacturing the device of claim 44, the method comprising:

providing a mold having a cavity configured for forming the device; and injecting a material into the mold at an injection area corresponding to the central portion of the bottom of the device.

64. A device for selectively immobilizing a container on a surface, the device comprising:

a mounting element configured to engage the container; and a bottom comprising a central portion, a peripheral edge forming a lip, a groove configured to engage the container, and a plurality of openings intermediate the central portion and the peripheral edge of the bottom, the openings being separated by at least one radially extending tab, wherein the bottom is configured such that at least the container and the bottom cooperate to form a suction cavity for selectively immobilizing the container on the surface, and wherein the device is formed as a single-piece molded product.

65. The device of claim 64, wherein the openings comprise four openings and wherein adjacent pairs of openings are separated by one of four tabs spaced 90 degrees with respect to one another.

66. A combination of a container and a device for selectively immobilizing the container on a surface, the combination comprising:

a container defining a height dimension and a cross-section dimension, the container comprising a body having a terminal end defining a bottom; and a device mounted on the terminal end of the container body, the device comprising a mounting element engaging the container, and a bottom comprising a central portion comprising material, a peripheral edge forming a lip, and at least one opening extending away from the central portion, wherein the bottom is configured such that at least the container and the bottom cooperate to form a suction cavity for selectively immobilizing the container on the surface, and wherein the height dimension of the container is significantly greater than the cross-section dimension of the container.

67. The combination of claim 66, wherein the container comprises an aerosol container.

68. The combination of claim 66, further comprising a hairstyling product contained in the container.

* * * * *